United States Patent [19]

Kogiso et al.

[11] Patent Number: 4,551,969

[45] Date of Patent: Nov. 12, 1985

[54] APPARATUS FOR CONTROLLING THE WINDING SPEED OF ROVING IN ROVING FRAME

[75] Inventors: Takashi Kogiso, Mizunami; Katsutoshi Kishi, Gifu; Hachirou Yokoyama, Aichi, all of Japan

[73] Assignee: Howa Kogyo Kabushiki Kaisha, Nagoya, Japan

[21] Appl. No.: 635,892

[22] Filed: Jul. 30, 1984

[30] Foreign Application Priority Data

Aug. 2, 1983 [JP] Japan ..... 58-141300
Nov. 22, 1983 [JP] Japan ..... 58-220087

[51] Int. Cl.[4] ..... D01H 1/26; D01H 13/32
[52] U.S. Cl. ..... 57/264; 57/96
[58] Field of Search ..... 57/96, 264, 265, 92–94, 57/100

[56] References Cited

U.S. PATENT DOCUMENTS 3,892,064 7/1975 Araki et al. ..... 57/96
4,134,253 1/1979 Handa et al. ..... 57/96
4,254,615 3/1981 Adolf et al. ..... 57/96
4,375,744 3/1983 Briner et al. ..... 57/264 X
4,467,592 8/1984 Araki ..... 57/264 X
4,467,593 8/1984 Araki ..... 57/264 X

*Primary Examiner*—John Petrakes
*Attorney, Agent, or Firm*—Michael N. Meller

[57] ABSTRACT

An apparatus for controlling the roving winding speed in a roving frame, in which a roving position detecting unit detects central positions of vibration of the roving in the vertical direction while suspended between a front roller of the drafting device and a flyer top by means of a plurality of photoelectric sensors. An average central vertical position of the vibrating roving is computed from the values measured by the roving position detecting unit, and a correction amount of the rotation speed of a bobbin is computed from the difference between the average central position and a desired value for controlling the roving winding speed and from a correction coefficient. A correction signal is generated corresponding to the correction amount, and the rotation speed of the bobbin is regulated based on the correction signal.

5 Claims, 12 Drawing Figures

1
2
3
4
5
6
7
8
9
10
11
12
13
14
15
16
17
18
19
20
21
22
23
24
25
26
27
28
29
30
31
32
33
34
35
36
37
38
39
40
41
42
43
44
44a
44c
45
45a
46
47
48
49
50
51
52
53
54
55
56
59
69
70
71
71a
72
73
A

APPARATUS FOR CONTROLLING THE WINDING SPEED OF ROVING IN ROVING FRAME

BACKGROUND OF THE INVENTION (1) Field of the Invention

The present invention relates to an apparatus for controlling the winding speed of roving in a so-called bobbin-lead type roving frame, wherein a roving twisted by a flyer rotated at a predetermined speed is wound on a bobbin rotated at a speed higher than the rotation speed of the flyer to form a package of a predetermined size. More particularly, it relates to an apparatus for controlling the winding speed of the roving in the above-mentioned roving frame wherein the winding speed of the roving is automatically controlled so that the tension on the roving is always maintained at a desired value during the period from the starting point of the winding operation to the point of the completion of forming a full-package roving bobbin.

(2) Description of the Prior Art

In winding a twisted roving in the form of layers on a bobbin in a conventional bobbin-lead type roving frame, in order to always maintain the winding speed of the roving at the same level as the spinning speed of the roving from a drafting apparatus, a mechanism for reducing the winding speed, including a pair of cone drums, is built in a bobbin driving system, and an endless belt wound mounted on the paired cone drums is displaced by a predetermined distance for forming every layer of a package so that the rotation speed of the bobbin can be gradually decreased from one layer to the next layer of roving.

However, the winding speed of the roving for every layer is not simply proportional to the number of layers of the roving but is delicately changed according to the spinning conditions such as the kind of roving fiber, the properties of the fiber, the count number of the roving, the twist number of the roving, and the compressive force of a presser. Accordingly, where only one kind of paired cone drums is used in which the design is based on a certain special spinning condition, it is practically very difficult to maintain the winding speed of the roving for every layer of the package at the same level throughout a broad range of the spinning conditions. Therefore, a system in which the displacement distance of the belt for forming every layer of a package is adjusted by an auxiliary cam that can be adjusted according to the spinning conditions has been marketed. However, the method using this auxiliary cam is not preferred from the practical viewpoint because trial spinning should be effected to determine the displacement distance of the belt along the cone drums for forming every layer of a package, every time the spinning conditions are changed.

Recently, Japanese Examined Patent Publication No. 51-22532 has proposed a method in which the number of teeth of a ratchet wheel, which is a driving source of a shifter for displacing a belt along paired cone drums, is set at a level smaller by about one than a predetermined tooth number so that the belt is slightly over-displaced and a roving being wound between the nip point of the front roller of a drafting device and a flyer is slackened. The accumulation of such slack is detected by photoelectric means to actuate a control motor for only a short time and this control input is applied to a gear row from a gear engaged with a rack lever of the shifter to the ratchet wheel to slightly return the forward displacement of the belt, whereby the rotation speed of the bobbin is corrected. According to this method, at every exchange of the yarn layers on the bobbin, the belt is over-displaced and the roving is wound under the slightly slackened condition, and when such slacks of roving, which are created between the nip point of the front rollers of the drafting device and a flyer, are accumulated, the position of the belt is returned to increase the roving tension and the roving is wound in this state. Accordingly, when a roving is wound according to this method, the roving tension is increased once for a certain number of layers, and the adjusted value of roving tension changed by one correction is relatively large, so that there is a strong possibility of an abrupt change in the roving tension. Therefore, deformation is readily caused on both ends of the package. Moreover, when the count number of the roving which is related to the winding speed, is changed beyond a certain degree, the tooth number of the ratchet wheel should be changed.

Furthermore, Japanese Examined Patent Publication No. 56-25525 proposes a roving winding apparatus in a roving frame, in which an external force is applied to a roving between a front roller of a drafting device and a flyer top by a jetted air stream to positively vibrate the roving, the inherent frequency of vibration being measured by a frequency measuring device. The inherent frequency of vibration is compared with a predetermined frequency, and when there is a deviation of the inherent frequency of vibration from the predetermined frequency of vibration, the rotation speed of the bobbin is increased or decreased according to the value of this deviation so that the roving is wound under a constant roving tension throughout the period from the start of the winding operation to the completion of the winding operation. However, in this roving winding apparatus, an air stream is intermittently jetted against the roving between the front roller of the drafting device and the flyer top to positively create the vibration of the roving, and the pressure of the air stream intermittently jetted against the roving acts on a sample spindle provided with an air jetting device. Therefore, especially in the case of a loosely twisted roving of a synthetic fiber or a blend thereof, irregular drafting is readily caused in the roving between the front roller and the flyer top and many fluffs are possibly created. Moreover, a difference in the roving tension is created between the sample spindle and other spindles, because of the jetting of an air stream onto the roving of the sample spindle. Accordingly, this apparatus has a defect such that it is impossible to maintain uniform winding conditions in all the spindles. In this roving winding apparatus, an external force is applied to a roving between the front roller and the flyer top to positively create the vibration of the roving, the inherent frequency of vibration at the time of application of this external force being measured as a value corresponding to the roving tension. This inherent frequency of vibration is compared with a predetermined frequency of vibration, and the rotation speed of the bobbin is increased or decreased according to a deviation of the inherent frequency of vibration from the predetermined frequency of vibration. Accordingly, in this roving winding apparatus, the value of the frequency of vibration predetermined by a preset value defining device is an important factor for maintaining the roving tension at a certain appropriate level. The frequency of vibration varies according to the differences of the count number of the roving and the kinds of fibers concerned. Accordingly, in order to regulate the predetermined frequency of vibration to an appropriate value within a broad range of spinning conditions (such as the kinds and properties of the fiber, the count number of the roving, and twist number of the roving), it is necessary to find an appropriate roving tension for respective spinning conditions by trial spinning, and to determine the inherent frequency of vibration at the time when a jet air stream blows against a roving under the appropriate roving tension and to set the so-determined inherent frequency of vibration in the preset value defining apparatus. Accordingly, in such a conventional roving frame provided with a roving winding apparatus as mentioned above, even if the roving winding apparatus has a function of winding a roving under a constant roving tension, in order to determine the predetermined frequency of vibration in the winding apparatus, the above-mentioned troublesome operations, which are more complicated than the operations adopted in the conventional roving frame provided with the auxiliary cam, should be performed every time the spinning conditions are changed. Thus, the roving frame of this type is not preferred from the practical viewpoint.

It is well known that a centrifugal force imposed on a roving which forms the outside layer of a bobbin is increased as the diameter of the bobbin is increased. Such increase of the centrifugal force is distinguished if the rotation speed of the flyer is increased. Because of the recent tendency of increasing the speed of the roving frame, it must be recognized that the increase of the speed of the roving frame produces an undesirable increase of such centrifugal force by which weak portions of roving are frequently created, so that the number of breakages of the roving is increased as compared with the conventional roving frame. This has become a serious problem which must be solved. Accordingly, there has been adopted a method in which the rotation speed of the machine is gradually decreased with the increase of the wound diameter of the bobbin. This method, however, is defective in that since the rotation speed of the machine per se is decreased, the production rate is decreased. If it is intended to increase the production rate by increasing the operation speed, this method is not suitable and the apparatus becomes complicated and expensive.

Incidentally, it is known that in the spinning operation in a roving frame, uneven twisting is caused while a roving is fed from a front roller and wound on a bobbin, and a loosely twisted portion is poor in tensile strength and the strength of this portion is further reduced by a tension or frictional force imposed on the roving during the spinning portion. This portion will be called the "weak portion of the roving" hereinafter.

SUMMARY OF THE INVENTION

It is a primary object of the present invention to overcome the above-mentioned defects of the known conventional techniques.

A second object of the present invention is to solve the above-mentioned problem of the centrifugal force caused by the increase of the rotation speed of the machine.

With a view to attaining the foregoing objects, research was carried out in which it was noted that an average central position of the roving vibrating in the vertical direction, which vibration is created during the spinning operation while the roving is suspended between a front roller and a flyer top, can be adopted as a value corresponding to the roving tension. Based on this concept, according to the present invention, the first object is attained by a basic structure of the invention described below.

That is, the basic structure of the present invention comprises (a) roving-position-detecting means for detecting positions of the roving during vibration in the vertical direction created in a roving suspended between a front roller and a flyer top, which is provided with a plurality of photoelectric sensors, (b) means for computing an average central position of the vibrating roving in the vertical direction from the values measured by the roving-position-detecting means, (c) correction-signal generating means for first computing a correction value of a rotation speed of a bobbin from a deviation value equal to the difference between the computed average central position and a predetermined position, and a correction coefficient and then, generating a signal corresponding to the computed correction value, and (d) and change a device for changing the rotation speed of the bobbin according to the generated correction signal.

The second object of the present invention is attained in the above-mentioned basic structure of the present invention by adding a desired standard position setting means for setting a desired position of the roving (called "desired standard position" hereinafter) corresponding to the standard roving wound diameter, throughout the period from the starting point of the winding operation to the completion of the winding operation, so that the tension value is decreased with the increase of the roving wound diameter from the starting point of the winding operation or a point of arriving at the predetermined wound diameter to the completion of the winding operation, while taking the increase of a centrifugal force caused by the increase of the roving wound diameter into consideration, and a desired position computing means for computing a desired position of the roving which corresponds to the roving wound diameter between adjacent standard wound diameters relating to the desired standard wound diameters utilizing a plurality of desired set standard positions.

According to the basic structure of the present invention, there is provided an apparatus for controlling a roving winding speed in a roving frame, in which such defects, which can be observed in the above-mentioned conventional apparatus, as deformation of the package, uneven drafting of the roving in a sample spindle, increase of fluffs and generation of a difference of the roving tension between the sample spindle and other spindle, can be completely eliminated, by setting the desired position of the roving at an appropriate position at the start of the operation. Thereafter the desired position of the roving need not be changed, because the average central position of the vibrating roving is kept at the desired position even if the spinning conditions are changed afterward. The rotation speed of the bobbin is automatically controlled so that the rotation speed of the bobbin is always in accord with the speed of feeding the roving from a drafting device during the period from the starting point of the winding operation to the completion of the winding operation to produce full packaged roving bobbins, so that the roving tension is kept at a suitable condition throughout the period of the winding operation, so that the full packaged roving bobbin in a desirable condition can be obtained.

By adding the above-mentioned necessary elements to the basic structure of the present invention, for attaining the second object of the present invention, the tension imposed on a roving is reduced with increase of a centrifugal force so that the possible creation of weak portions in the roving can be prevented, and accordingly, the possible occurrence of roving breakage in a portion, where the roving wound diameter is large, can be effectively prevented, and a package having a good shape can be obtained without reducing the rotation speed of the roving frame.

Figure 1:
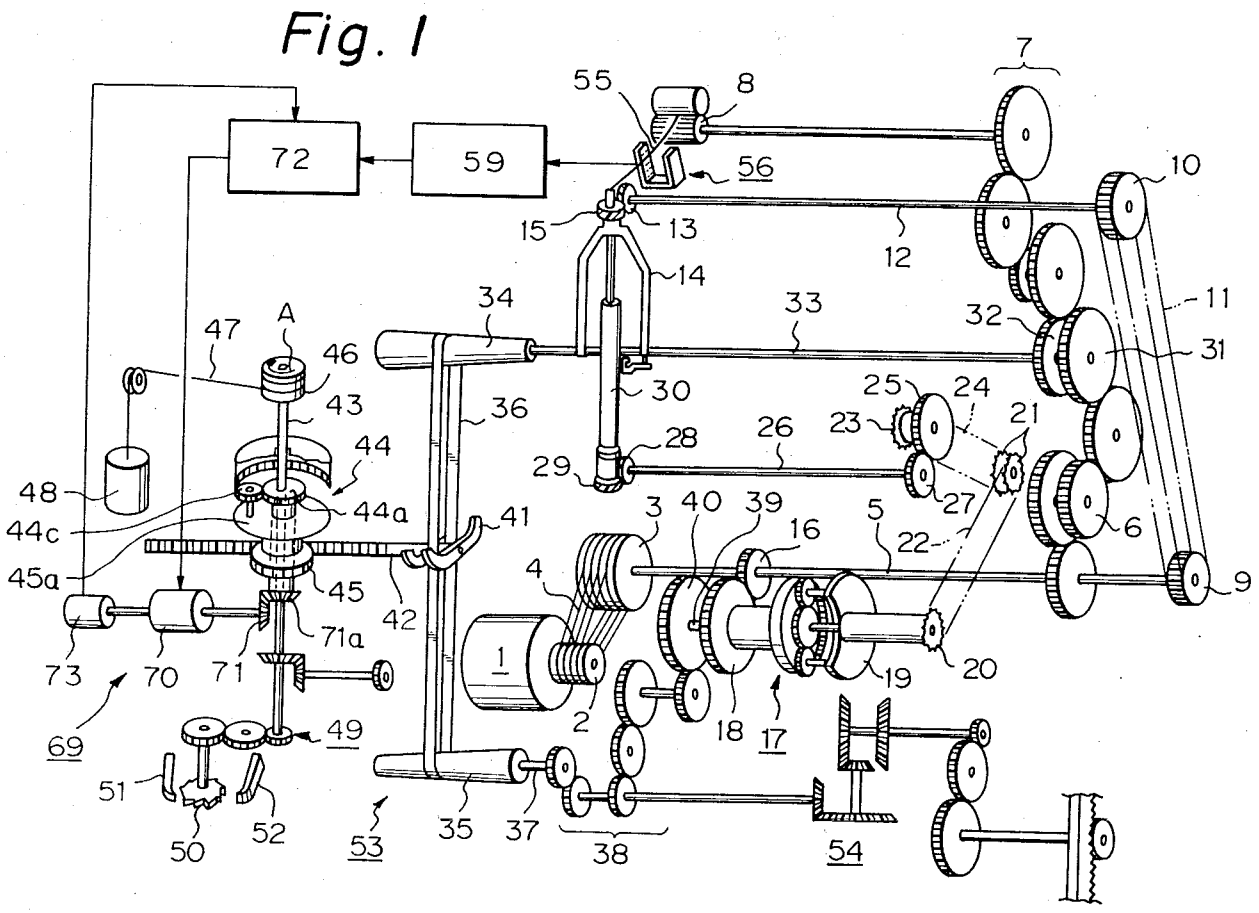
FIG. 1 is a diagram illustrating the entire structure of a first example of the present invention.

DESCRIPTION OF THE PREFERRED EMBODIMENTS (1) Basic Structure of Present Invention and Operations Thereof Referring to FIG. 1 illustrating a first example of the bobbin-lead type roving frame according to the present invention, a driving shaft 5 is driven by a main motor 1 through V-pulleys 2 and 3 and a V-belt 4, and a front roller 8 of a drafting device is driven by the driving shaft 5 through a gear row 7 in which a twist change gear 6 is included. Furthermore, a flyer driving top shaft 12 is driven by the driving shaft 5 through pulleys 9 and 10 and a timing belt 11, and a gear 13 secured to the top shaft 12 is engaged with a gear 15 secured to a flyer 14 of the top supporting type to rotate and drive the flyer 14 at a constant speed. Separately, a gear 16 secured to the driving shaft 5 is engaged with an outer gear 18 of a differential gear mechanism 17, and a chain 22 is wound between a chain wheel 20 mounted on the shaft end of a rotary disc 19 of the differential gear mechanism 17 and an intermediate chain wheel 21, and a chain 24 is wound between the intermediate chain wheel 21 and another chain wheel 23. A gear 25 coaxial with the chain wheel 23 is engaged with a gear 27 of a bobbin shaft 26 and a gear 28 on the bobbin shaft 26 is engaged with a bobbin wheel 29 for driving a bobbin 30, whereby, if the input of rotation power by an input shaft 39 is not provided, a constant speed driving mechanism for driving the bobbin 30 at the same rotation speed as that of the flyer 14 is constructed. A top cone drum 34 is secured to a top cone drum shaft 33 to which intermediate gears 31 and 32 of the gear row 7 are secured, and a belt 36 is wound between the top cone drum 34 and a bottom cone drum 35 supported below the top cone drum 34. An output shaft 37 of the bottom cone drum 35 is connected to a gear 40 attached to the input shaft 39 of the differential gear mechanism 17 through a gear row 38. A rack 42 is connected to a belt shifter 41 for moving the belt 36 and this rack 42 is engaged with an outer gear 45 on the output side of a differential gear mechanism 44 attached to a vertical shaft 43.

Figure 2:
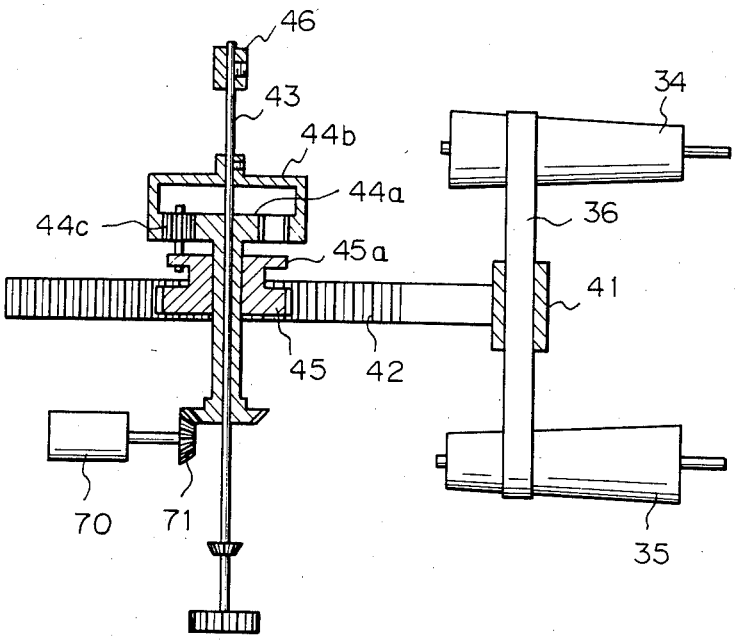
FIG. 2 is a detailed diagram illustrating the differential gear mechanism applied for the roving frame shown in FIG. 1.

Referring to FIG. 2 the outer gear 45 is provided with a disc **45*a* formed at the upper portion thereof as one body. A shaft of a sun gear 44*a* passes through the outer gear 45 and projects downward so that the sun gear 44*a* is formed with a bevel gear 71*a* as one body. The sun gear 44*a* is capable of turning relatively to the outer gear 45. The vertical shaft 43 passes through the sun gear 44*a* along the central axis thereof so that the shaft 43 is capable of turning relatively to the sun gear 44*a* etc. The vertical shaft 43 is further connected to an internal gear 44*b* by a key (not shown) so that the internal gear 44*b* is rotated in cooperation with the sun gear 44*a* by means of a planet gear 44*c***.

The vertical shaft 43 is urged in the direction of arrow A through a pulley 46 secured to the top end of the vertical shaft 43, a rope 47, and a weight 48. Rotation of the vertical shaft 43 is regulated by a ratchet wheel 50 connected through a lowest gear row 49 and claws 51 and 52, and these claws 51 and 52 co-operate with a known fashioning device (not shown) and engage with and separate from the ratchet wheel 50 alternately on both ends of the formation of a package, whereby the vertical shaft 43 is intermittently turned in the direction of arrow A by a predetermined quantity on both end portions of the vertical movement of a bobbin rail (not shown) by the urging force of the weight 48. By this turning of the vertical shaft 43, the rack 42, belt shifter 41, and belt 36 are intermittently transported from the left side to the right side in FIG. 1 by a predetermined distance through the differential gear mechanism 44 and outer gear 45, and an ordinary bobbin speed changing apparatus 53 is arranged so that the increase of the rotation speed of the bobbin with respect to the rotation speed of the flyer 14 for winding the roving is gradually decreased by a predetermined quantity for every layer of roving wound during formation of a package and the speed of winding the roving is made equal to the speed of feeding the roving from the front roller 8. Accordingly, the bobbin 30 mounted on a flyer shaft **14*a* at a position between the flyer 14 and the bobbin wheel 29 is rotated under conditions such that the constant speed component (same as the rotation speed of the flyer), given by the constant speed driving mechanism formed by elements from the gear 16 of the driving shaft 5 to the bobbin wheel 29, is synthesized with the increased speed component given by the bobbin speed changing apparatus 53 for winding the bobbin by means of the differential gear mechanism 17, and therefore, the bobbin 30 is rotated at a higher speed than the speed of the flyer 14 and the roving 55 delivered from the front roller 8 and twisted by the flyer 14 is wound in the form of layers on the bobbin 30 by the vertical movement of the bobbin rail (not shown), whereby a predetermined package is created. Incidentally, reference numeral 54** represents a known apparatus for vertically moving the bobbin rail.

Figure 3:
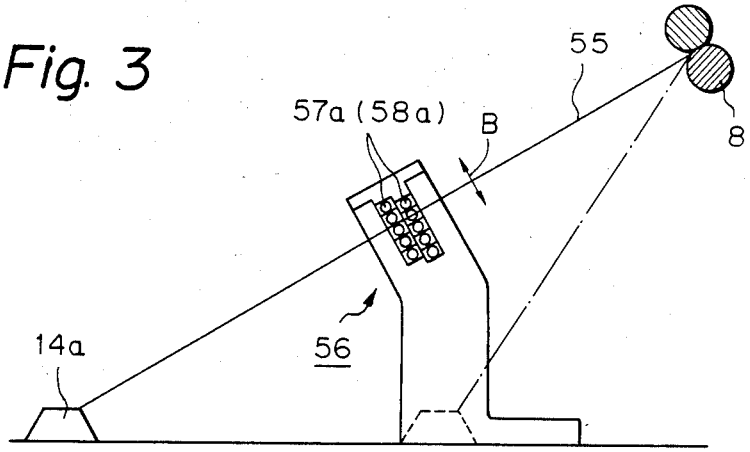
FIG. 3 is a side view of a roving position detecting device.

In FIGS. 1 and 3, reference numeral 56 represents a roving position detecting apparatus disposed between the front roller 8 of the drafting apparatus and the flyer top 14*a*. In this roving position detecting apparatus 56, on both sides of the roving 55 between the front roller 8 and the flyer top 14*a*, respective pluralities of light transmitters 57*a* and light receivers 58*a* (ten of the light transmitters and receivers on one side are shown in FIG. 3) are arranged in one row or two rows (two rows in the embodiment shown in the drawings) so that the light transmitters 57*a* confront the corresponding light receivers 58*a* to form a plurality of photoelectric sensors, comprising respective pluralities of light beam transmitters 57*a* and light receivers 58*a*. In such an arrangement of photoelectric sensors 57*a* and 58*a*, the distances between the roving 55 and the optical axis of each photoelectric sensor in the vertical direction of the vibration of the roving 55 are different from each other. These photoelectric sensors can detect the vertical vibration positions of the roving 55 suspended between the front roller 8 of the drafting device and the flyer top 14*a*. Incidentally, it is preferred that in the roving position detecting apparatus 56, the number of the photoelectric sensors be increased and the distance between every two adjacent photoelectric sensors in the direction of arrow B in FIG. 3 be as small as possible, so that the positions during vibration of the rovings 55 in the vertical direction can be detected as precisely as possible. An image sensor in which the distances between every two adjacent light receivers can be reduced or a photoelectric sensor constructed by using optical fibers may be used instead of the above-mentioned photoelectric sensor comprising a light transmitter and a light receiver. Where no high detection precision is necessary, the number of the photoelectric sensors may be reduced to two. Since the photoelectric sensors 57*a*, 58*a* of the roving position detecting apparatus 56 are disposed to detect the positions of the vibrating roving 55 with respect to the vertical direction, it is sufficient if the photoelectric sensors 57*a*, 58*a* are arranged so that they are different from one another in the distance between the roving 55 and the optical axis thereof. Therefore, the arrangement direction and setting position of the photoelectric sensors 57*a*, 58*a* are not limited to those illustrated in the drawings. Moreover, the roving position detecting apparatus 56 need not be arranged for all the spindles of the roving frame, but it is sufficient if the roving position detecting apparatus 56 is arranged in one spindle or two or three spindles in one roving frame.

Figure 4:
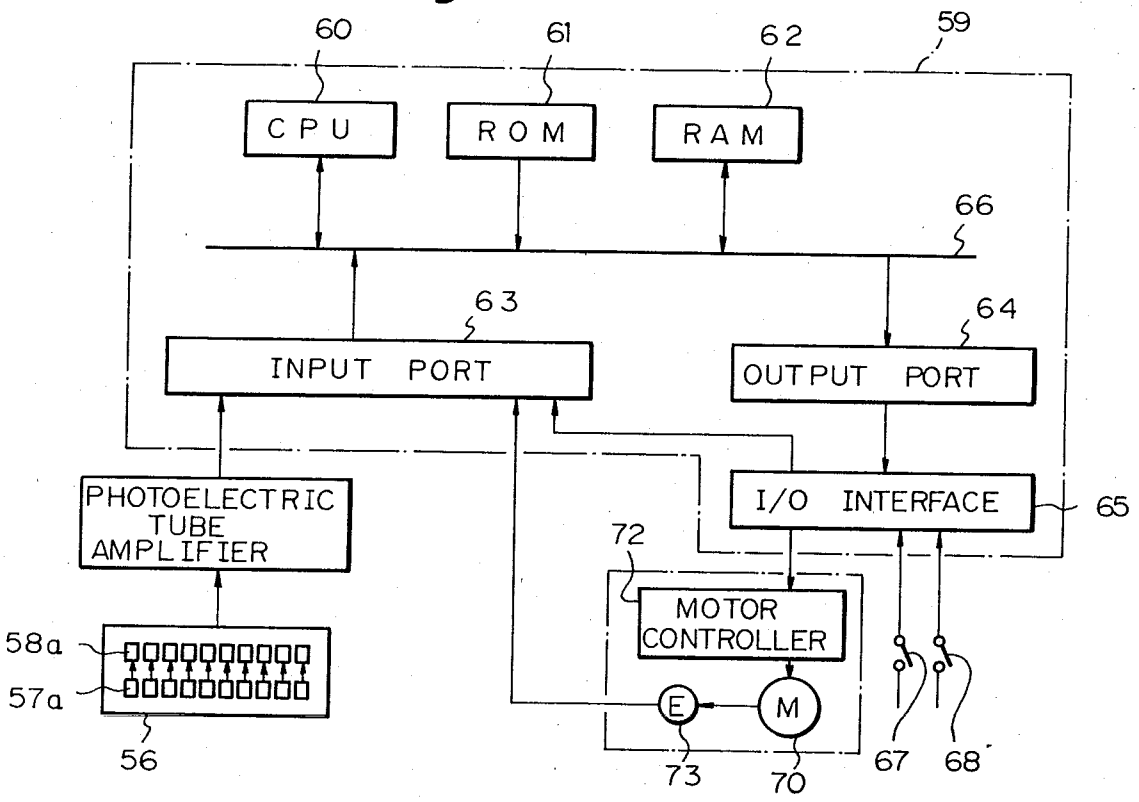
FIG. 4 is a structural diagram showing a microcomputer used in the first example.

Reference numeral 59 represents a microcomputer, and as shown in FIG. 4, this microcomputer comprises a CPU 60, a ROM 61, and RAM 62, an input port 63, an output port 64, and an I/O interface 65, which are connected through a bus line 66. A signal from the photoelectric sensors 57*a*, 58*a*, that is, a signal indicating the photoelectric tube where light is intercepted, is input to the input port 63, and a limit switch 67, arranged in an appropriate intermediate portion except for the position for changing over the vertical movement of the bobbin rail (not shown) to output a tension detection signal for initiating the detecting operation of the photoelectric sensors 57*a*, 58*a* relatively to the bobbin forming operation of the bobbin rail, and another limit switch 68, arranged to output a correction instructing signal for initiating the correction, are connected to the I/O interface 65 and the signals from these limit switches 67 and 68 are input to the input port 63.

A correction device 69 will now be described. A bevel gear 71 is arranged on an output shaft of a control motor 70, and a bevel gear 71*a* is freely mounted on the vertical shaft 43 of the differential gear mechanism 44 of the bobbin speed changing apparatus 53 and is engaged with the bevel gear 71. This bevel gear 71*a* is integrated with the sun gear 44*a* and the control motor 70 is connected to the sun gear 44*a*. A known motor controller 72 is connected to the I/O interface 65 to turn on and off the control motor 70 based on the computed result (correction value) in the microcomputer 59 and rotates the control motor 70 in the normal and reverse direction. An encoder 73 is arranged to detect the rotation of the control motor 70 and generate a pulse signal corresponding to the rotation speed of the control motor 70, and the encoder 73 turns off the motor controller 72 when the pulse signals are counted to a predetermined correction value.

The ordinary operation of the bobbin speed changing apparatus 53 in the first example having the above-mentioned structure will now be described. When the roving frame is started, a fiber bundle delivered from the front roller 8 of the drafting device is twisted by the flyer 14, which is rotated at a constant speed, to form a roving 55, and this roving 55 is turned about the rotational axis of the flyer 14 at a speed higher than the rotation speed of the flyer 14. Therefore the roving 55 is wound in the form of layers on the bobbin 30 while moving in the vertical direction with the vertical movement of the bobbin rail (not shown), whereby a predetermined package is formed. During this period from the starting point of the winding operation to the completion of the winding operation to produce the full packaged bobbin, every time the bobbin rail (not shown) reaches the top end and the lower end, the ratchet wheel 50 of the bobbin speed changing apparatus 53 is turned by predetermined quantities in the direction of arrow A by the urging force of the weight 48 by the attachment and separation of the claws 51 and 52 operated with the known fashioning apparatus (not shown). By the rotation of this ratchet wheel 50, the outer gear 45 is rotated in the direction of arrow A by way of the gear row 49, vertical shaft 43 and differential gear mechanism 44, and by the rotation of the outer gear 45, the belt 36 wound between the upper and lower cone drums 34 and 35 is moved by a predetermined distance from the left side to the right side in FIG. 1 by means of the rack 42 and belt shifter 41. By this displacement of the belt 36, the rotation speed of the bobbin is reduced by a predetermined quantity for every layer of the package.

Figure 5:
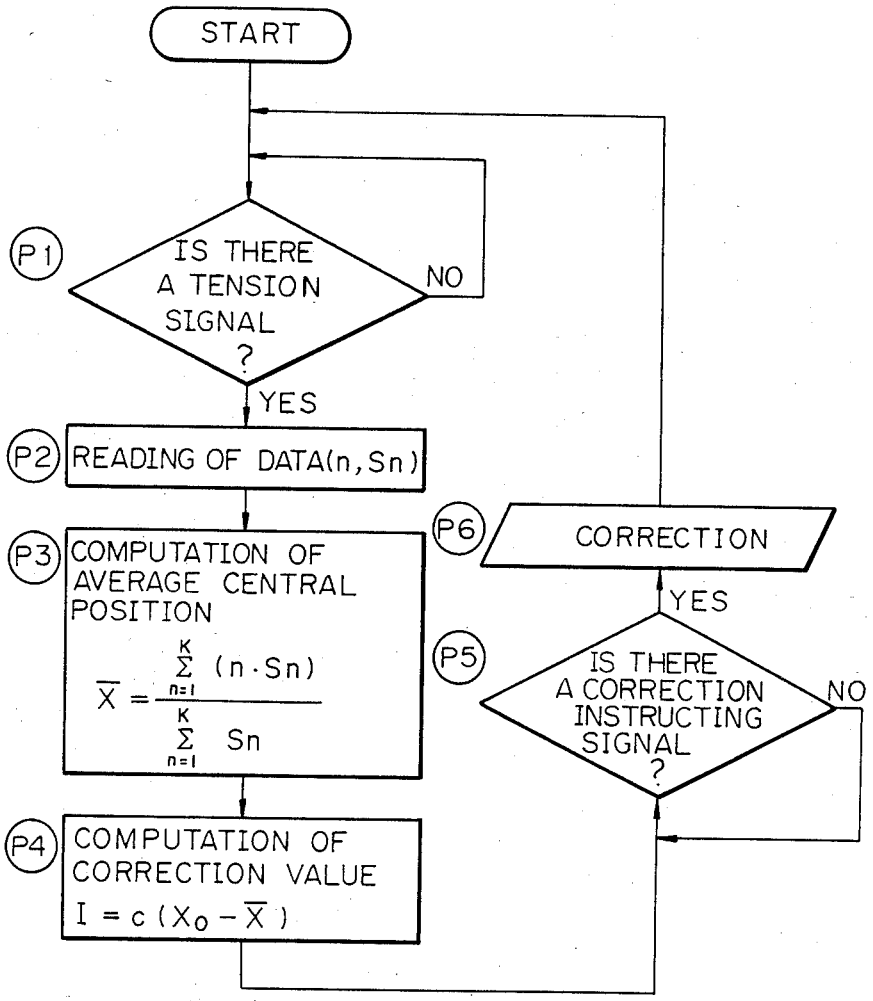
FIG. 5 is a flow chart showing the operations of the first example.

The operation of the correction apparatus 69 will now be described with reference to the flow chart of FIG. 5. When electric power is applied to the machine, a program is simultaneously started, and at step P1, a tension detection signal is supplied from the limit switch 67 disposed relatively to the bobbin forming operation. At step P2, a light interception frequency (or a light interception time) Sn ($n=1, 2, 3, \ldots$) of the photoelectric sensor in which the light is intercepted by the roving is recorded in a memory address of the RAM 62 corresponding to the number n ($n=1, 2, 3, \ldots$) of the photoelectric sensor.

At the subsequent step P3, the average central value $\overline{X}$ of the position of the roving 55 which vibrates in the vertical direction is computed by the CPU 60. A mathematical algorithm for calculating the value $\overline{X}$ according to the following equation is recorded in the ROM 61:

$$\overline{X} = \frac{\sum_{n=1}^{K} (n \cdot Sn)}{\sum_{n=1}^{K} Sn}$$

wherein K stands for the total number of photoelectric sensors.

The operation of the photoelectric sensors is carried out in a condition wherein, for example, the frequency of issuing the light-beams from the light-beam transmitter 57*a* is 50 pulses/sec, for several seconds, that is, in this example the detecting operation of the photoelectric sensors is carried out with the detecting frequency of 250/5 pulses/sec. The CPU 60 performs predetermined calculations by using the data written in the RAM 62 as a variable according to a specified program from the ROM 61. By this calculation the average central position $\overline{X}$ for vibration of the roving in the vertical direction is calculated. At the subsequent step P4, the deviation value between the desired position $X_0$ stored in the ROM 61 and the above-mentioned value $\overline{X}$ and the correction value I (corresponding to the rotation speed of the bobbin) obtained by multiplying this deviation value by the correction coefficient C are calculated by the CPU 60 in accordance with the problem in ROM 61.

In this embodiment, the desired position $X_0$ is constant and has no relationship with the wound diameter of the roving bobbin. A mathematical algorithm based on the following equation is stored in the ROM 61:

$$I = C(X_0 - X)$$

The correction coefficient C relates to the corrected displacement of the cone belt so as to bring the deviation value $(X_0 - \overline{X})$ rapidly to zero. For example, if the deviation value $(X_0 - X) = 0.1$ and the corrected displacement of the cone belt is 0.2 mm, in order to bring the deviation value rapidly to zero, the correction coefficient C can be set equal to 2.

If a correction instructing signal is received at the subsequent step P5, a correction signal is output at step P6. This output signal is transmitted to the motor controller 72, and on receipt of this correction signal, the motor controller 72 rotates the control motor 70 in the normal or reverse direction. The rotation amount of the control motor 70 is converted to pulsed signals by the encoder 73, and when the control motor 70 is rotated at a speed corresponding to the correction value I, a signal for stopping the control motor 70 is output. When the control motor 70 is thus rotated, the outer gear 45 of the bobbin speed changing apparatus 53 is rotated in the normal or reverse direction by means of the bevel gears 71 and 71*a* and the differential gear mechanism 44, and the belt 36 is moved to the right or left in FIG. 1 by means of the rack 42 and belt shifter 41 to decrease or increase the rotation speed of the bobbin in accordance with a correction amount corresponding to the correction value I, whereby the tension on the roving suspended between the front roller 8 and the bobbin 30 is corrected. Accordingly, by performing this correction of the rotation speed of the bobbin repeatedly, the roving tension is always maintained at an appropriate constant level during the period from the start of the winding operation to the completion of a full packaged bobbin.

For calculating the average central position $\overline{X}$ of the roving 55 in the vertical direction from the positions of the vibrating roving 55 in the vertical direction, which are detected by the roving position detecting apparatus 56, the following method may be adopted instead of the above-mentioned method. Namely, $\overline{X}$ is calculated from the number Hi of the photoelectric sensor located at a highest position among the photoelectric sensors where the light is intercepted, the number Li of the photoelectric sensor located at a lowest position among the light-intercepted photoelectric sensors, and the measurement frequency A using the mathematical algorithm stored in the ROM 61 according to the following equation, as in the above-mentioned method:

$$\overline{X} = \frac{\sum_{i=1}^{A} (Hi + Li)}{2A}$$

(2) Modification of First Example

Figure 6:
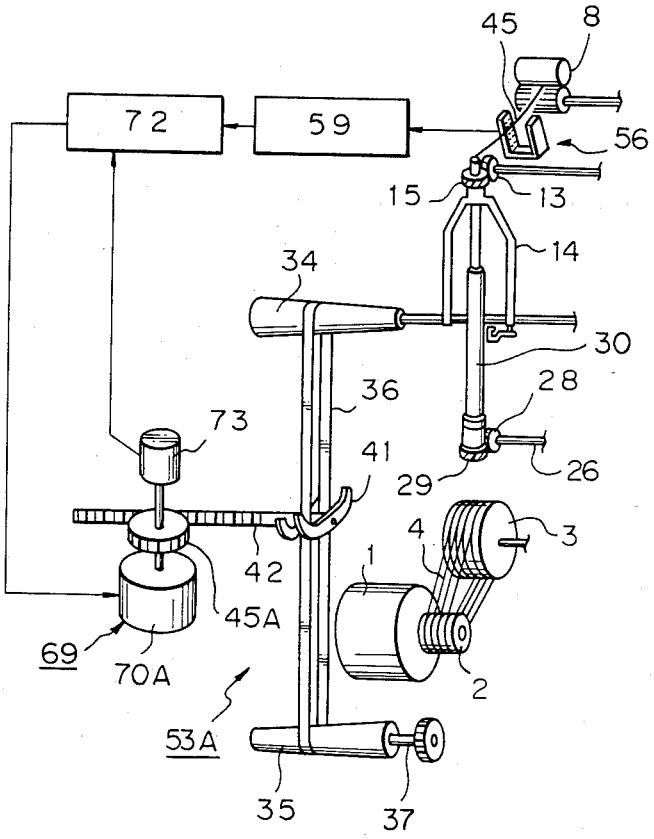
FIG. 6 is a diagram showing a main portion of a modification in which the control operation of the first example is partially changed.

In this modification, as shown in FIG. 6, a control motor 70A driven also by a correction signal is used as a driving source for a bobbin speed changing apparatus 53A and an outer gear 45A arranged on an output shaft of this control motor 70A is engaged with a rack 42 as a feed mechanism for a belt 36, so that constant amount of reduction of the rotation speed of a bobbin and correction of the rotation speed of the bobbin, performed in response to a change of the roving tension, are commonly effected by the control motor 70A. Furthermore, a limit switch is attached to detect the rising end and falling end of a bobbin rail (not shown), and this detection signal is input to an input port 63 through an I/O interface 65. A device for setting a standard change of speed is connected to the input port 63 to set a standard speed change value L0 for decreasing the rotation speed of the bobbin for every layer of a package.

Figure 7:
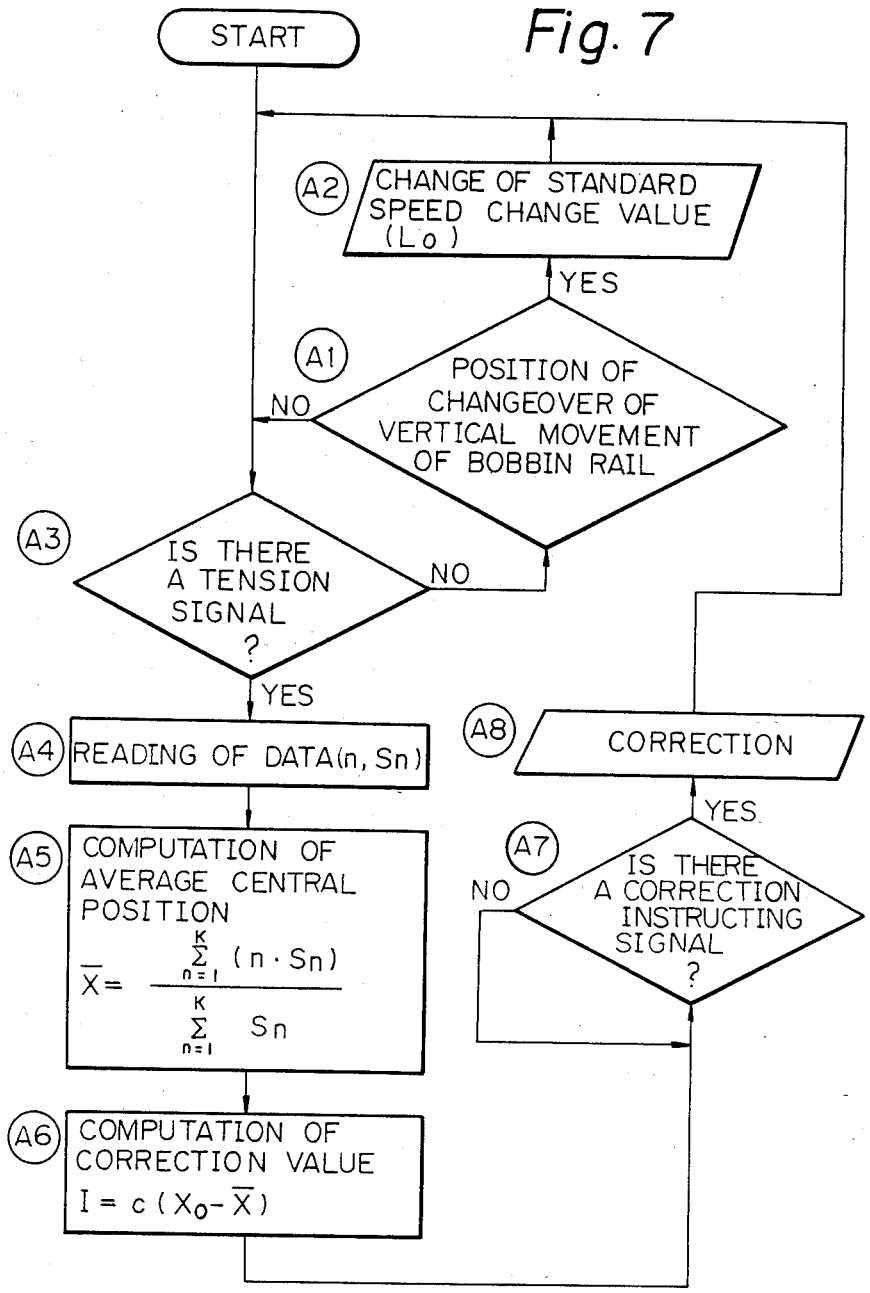
FIGS. 7 and 8 are flow charts showing the operations of the modification shown in FIG. 6.

The operation of the modification having the above-mentioned structure will now be described with reference to the flow chart of FIG. 7. As in the above-mentioned first example, during the period from the start of the winding operation to the completion of the winding operation to create a fully packaged bobbin, if there is no tension detection signal at step A3 and the bobbin rail is located at the rising end or falling end at step A1, a standard speed change signal corresponding to the standard speed change value L0 preliminarily set at step A2 is transmitted to the motor controller 72, and the motor controller 72 drives the control motor 70 based on this signal. By the rotation of the control motor 70, the belt 36 wound between upper and lower cone drums 34 and 35 is displaced by a predetermined quantity from the left to the right in FIG. 6 by means of the outer gear 45*a*, rack 42 and belt shifter 41, and by this displacement of the belt 36, the rotation speed of the bobbin 30 is decreased by a predetermined quantity for every layer of a package. If the bobbin rail is not located at the rising or falling position at step A1 and a tension detection signal is received at step A3 as in the first example, at steps A4 through A8, in the same manner as described in the first example, the data is read from the roving position detecting apparatus, the average central position $\overline{X}$ of the roving which vibrates in the vertical direction is computed, and the correction value I is computed and output. By this correction signal, the control motor 70*a* is driven and the belt 36 is displaced to the right or the left by means of the rack 42 and belt shifter 41, whereby the rotation speed of the bobbin is increased or decreased by an amount corresponding to the correction value I and the tension of the bobbin in the region between the front roller 8 and the bobbin 14 is adjusted.

Figure 8:
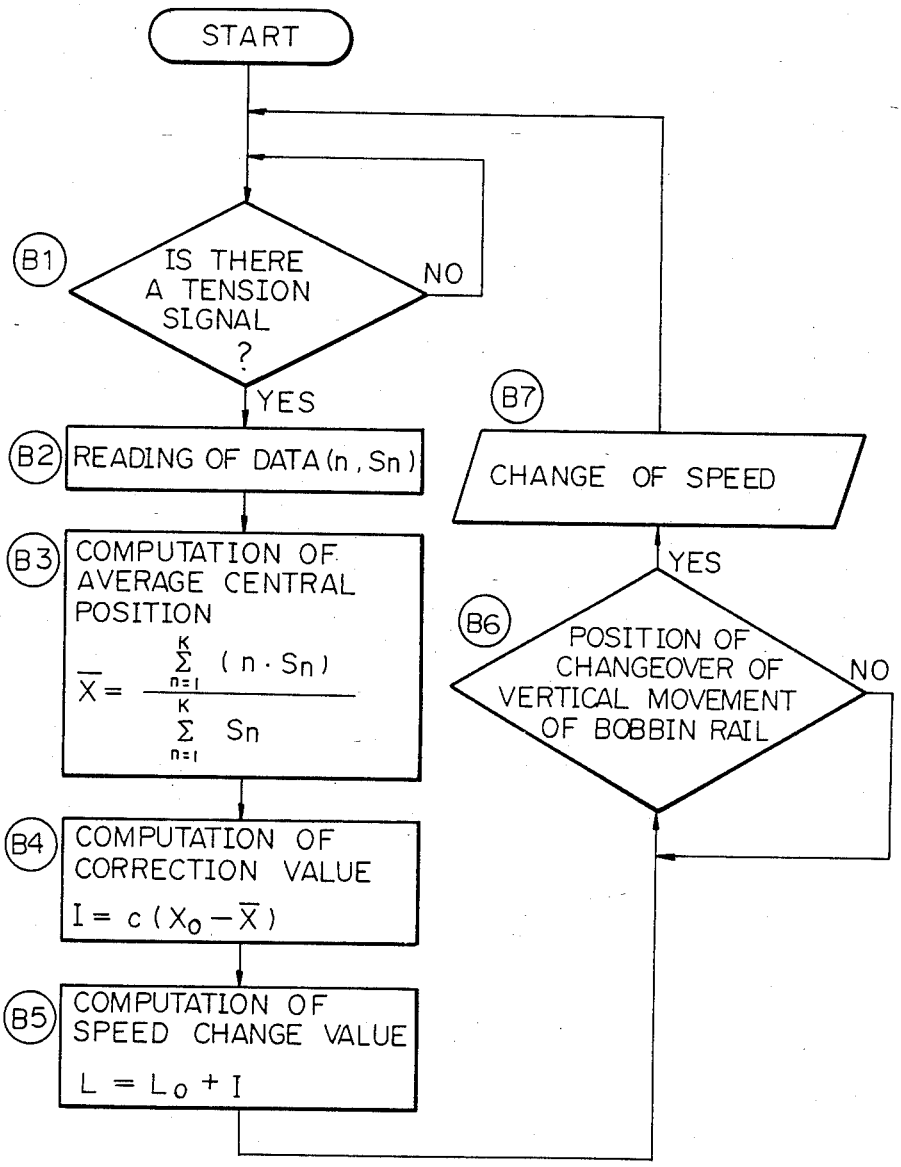

If the above-mentioned structure is adopted, control can be also accomplished according to the flow chart of FIG. 8. More specifically, the average central position $\overline{X}$ and correction value I are calculated at steps B1 through B4, and at step B5 a speed change value L (the sum of the standard speed change value L0 and correction value I) is calculated. At step B6, when the bobbin rail arrives at the rising-falling changeover position, a speed change signal corresponding to the above-mentioned speed change value L is output to the control motor 70*a* by the motor controller 72, whereby the belt 36 is displaced by means of the outer gear 45*a*, rack 42 and belt shifter 41 and both the standard speed change and the correction are simultaneously performed.

In the above-mentioned first example and modification, the cone drums are arranged as the speed change mechanism. In the present invention, however, the speed change mechanism is not particularly critical. For example, a chain type speed change mechanism or other known speed change mechanism may be used. In the modification of the first example shown in FIG. 6, the belt shifter 41 is displaced by means of the rack. In the present invention, however, the system for displacing the belt shifter 41 is not limited to the rack-feed system. For example, there may be adopted a method in which a lead screw lever is connected to the output shaft of the control motor. Moreover, the movement of the belt shifter can be performed by a pressurized fluid cylinder provided with a position detecting sensor.

As is apparent from the foregoing description, in the first example of the present invention, the positions of the roving as it vibrates in the vertical direction while suspending between the front roller and flyer top are detected by the roving position detecting device comprising a plurality of sets of photoelectric sensors, the average central position of the vibrating roving in the vertical direction is calculated from the measured values of the roving position detecting apparatus, the amount of correction of the rotation speed of the bobbin is calculated from the deviation between the desired set position of the roving and the average central position and the correction coefficient, and the rotation speed of the bobbin is controlled based on a correction signal corresponding to this correction quantity. Due to these structural features, in the present invention, if the desired position of the roving is first set appropriately once, the slackened condition of the roving suspended between the front roller of the drafting device and the flyer top can be kept constant even when the spinning conditions are subsequently changed, and therefore, the desired position of the roving need not be changed and the rotation number of the bobbin is automatically controlled so that the rotation speed of the bobbin is always in accord with the delivery speed of the drafting device throughout the period from the start of the winding operation to the completion of the winding operation to produce a fully packaged bobbin. Accordingly, the roving tension is always kept substantially constant during the winding operation to form a full bobbin, and a roving having a uniform thickness always can be spun in all the spindles and a package having good shape and good quality can be produced. Furthermore, in the present invention, the positions of the vibrating roving in the vertical direction can be detected while the roving is suspended between the front roller of the drafting device and the flyer top by non-contact type photoelectric sensors, and any slackening or external force need not be positively given to the roving to be detected, in contrast to the conventional technique where positive application of the slackening or external force is indispensable. Therefore, trouble such as deformation of a package, uneven drafting of the roving of the sample spindle, and increase of fluffs can be prevented, and no variation in the roving tension arises between the sample spindle and other spindles. Moreover, the photoelectric sensor has a simple structure and a small size and there is low risk of malfunction. Accordingly, the apparatus of the present invention can be attached to the conventional roving frame very easily and at a low cost.

(3) Second Example

As described in the summary of the invention, in the second example of the present invention, means for setting the desired standard position of the roving and means for computing the desired position based on the desired standard position are added to the above-mentioned basic structure of the first example.

Accordingly, explanations concerning the structure of the bobbin-lead type roving frame, to which the present invention is applied, and the basic structures of the elements of the first example which are similarly used in the second example, for example, the roving position detecting apparatus 56 and microcomputer 59, are omitted, and only the above-mentioned additional elements will now be described in detail.

Figure 10:
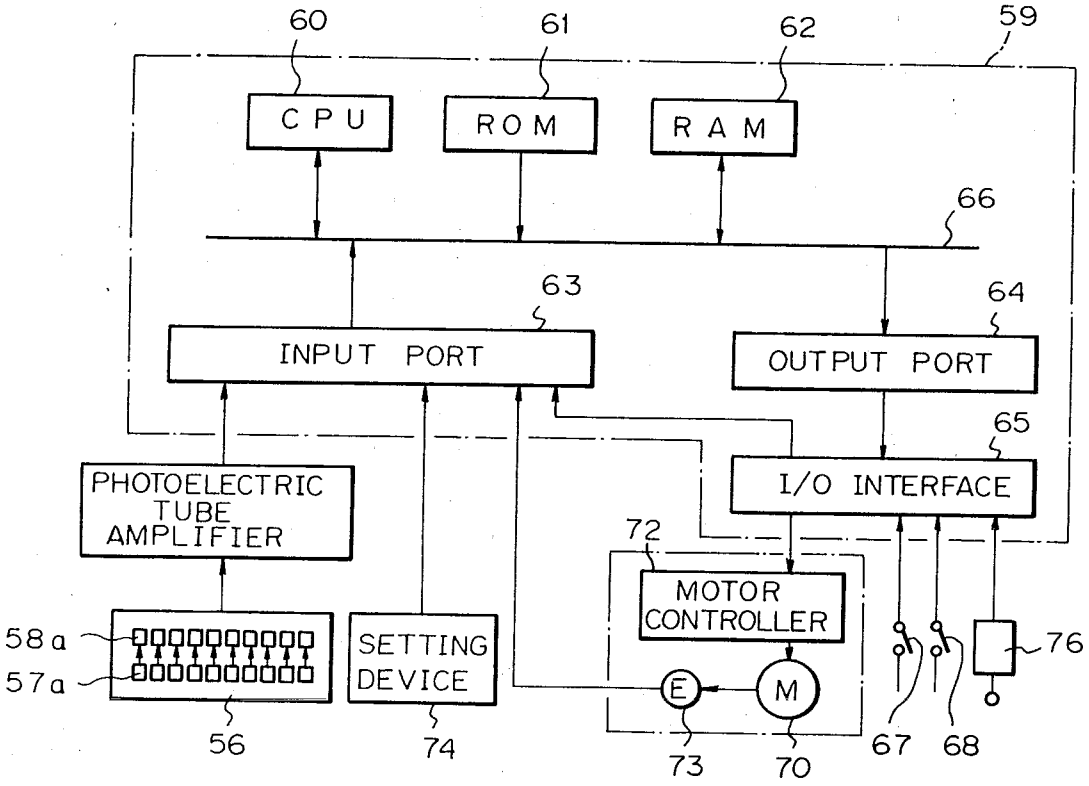
FIG. 10 is a structural diagram showing a microcomputer used in the second example.

In the second example, as described in the first example, a microcomputer 59 comprises a CPU 60, a ROM 61, a RAM 62, an input port 63, an output port 64, and an I/O interface 65 as shown in FIG. 10. Relative to this microcomputer 65, there is arranged a setting device 74 for setting from the outside a desired standard position $X_1$ corresponding to the tension at the start of the winding operation and a desired standard position $X_2$ corresponding to the tension at the end of the winding operation, and the setting device 74 is connected to the microcomputer 59 so that the set values are input to the input port 63.

Figure 9:
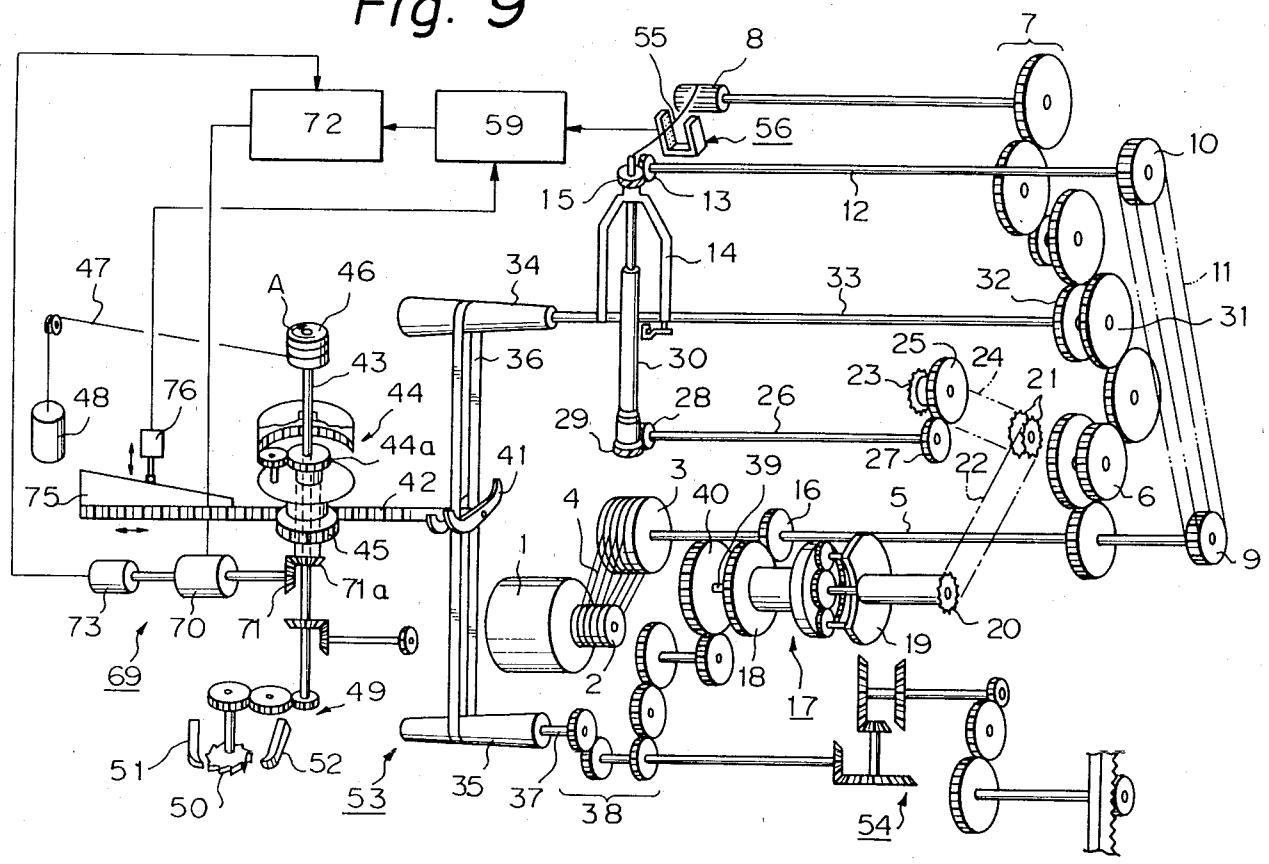
FIG. 9 is a diagram illustrating the entire structure of a second example of the present invention.

As shown in FIG. 9, a correction device 69 comprises a cam 75 for converting the displacement distance of a rack 42 for moving a cone belt 36 to a displaced distance in the vertical direction, so as to detect the wound diameter of the bobbin 30, and a slide volume 76 for detecting an angular displacement f of the cam 75 from the starting point, converting this quantity f to an electric signal, and inputting this electric signal to the microcomputer 59, in addition to the elements shown in the first example. The total angular movement quantity F of the cam 75 from the starting point to the terminal point of the winding operation is preliminarily stored in the ROM 61, and the starting point of the cam 75 corresponds to the wound diameter of the roving bobbin at the start of the winding operation and the terminal point of the cam 75 corresponds to the wound diameter of a full bobbin.

The operation of the second example having the above-mentioned structure will now be described. When the operation of the roving frame is started, as described in the first example, the rotation speed of the bobbin is decreased by a predetermined quantity for every layer of a package by the operation of the bobbin speed changing apparatus 53.

Figure 11:
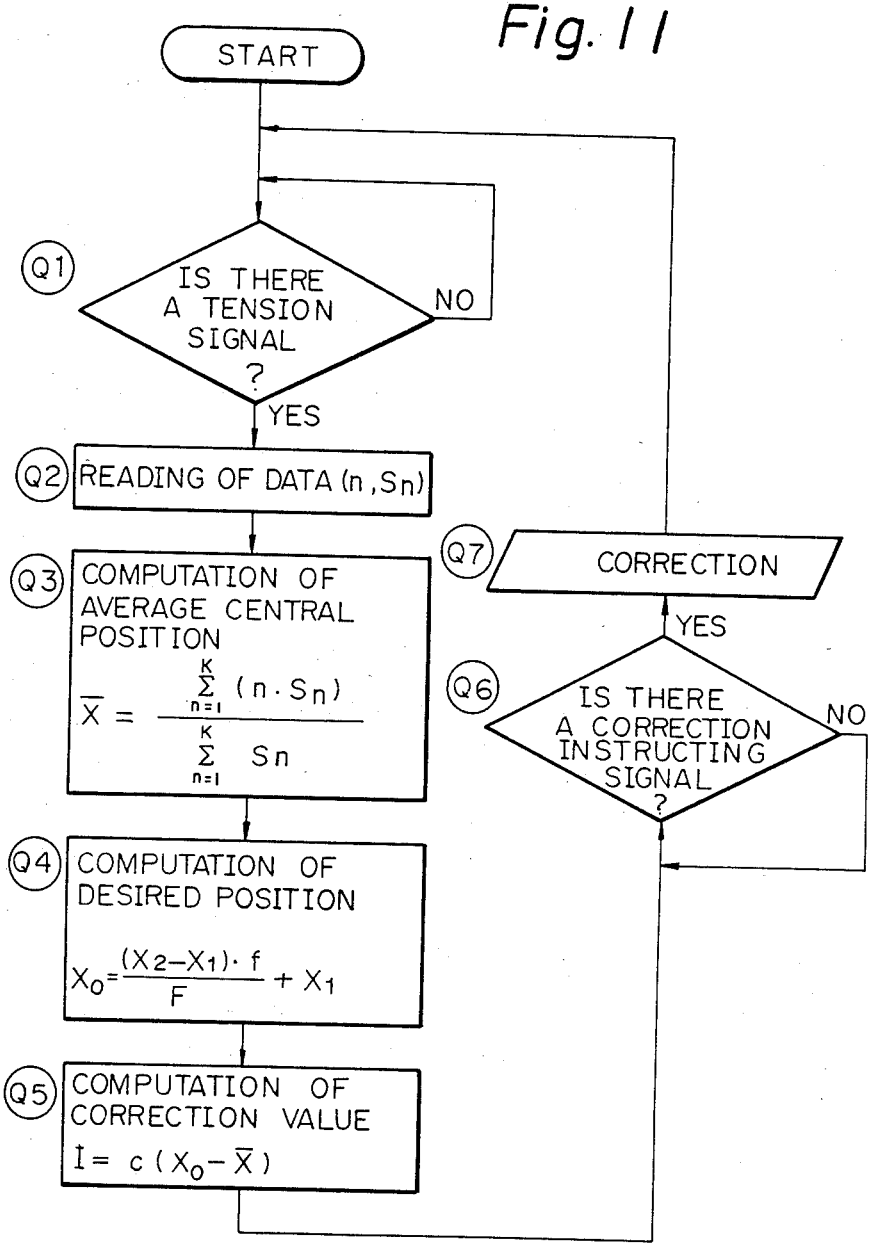
FIG. 11 is a flow chart showing the operations of the second example.

The operation of the correction device 69 will now be described with reference to the flow chart of FIG. 11. When electric power is applied to the machine, a program stored in the ROM 61 is simultaneously started. When a tension detection signal is input from a limit switch 67 attached relatively to the bobbin forming operation at step Q1, the average central position $\overline{X}$ of the roving vibrating in the vertical direction is computed at steps Q2 and Q3 by the CPU 60, in the same manner as described in the first example.

At the subsequent step Q4, the desired position X0 of the roving 55 suspended between the front roller 8 and flyer top 14*a*, which corresponds to the present wound diameter of the roving bobbin, is calculated by the CPU 60 from the desired standard position $X_1$ corresponding to the tension at the starting point of the winding operation, which is stored in the RAM 62 by the setting device 74, from the desired standard position $X_2$ corresponding to the tension at the terminal point of the winding operation, from the present position f of the cam 75 indicated by the slide volume 76, and from the total turning movement quantity F of the cam 75 stored in the ROM 61, according to the mathematical algorithm stored in the ROM 61 based on the following equation:

$$X_0=(X_2-X_1)\cdot f/F+X_1$$

The desired standard position $X_1$ is determined by trial spinning operations so as to obtain an optimum roving tension such that the roving is substantially linear when suspended between the front roller 8 and flyer top 14*a* as shown in FIG. 3, the roving is wound relatively tightly at the start of the winding operation and the roving resists a centrifugal force at the initiation of the winding operation so that possible breakage of the roving can be prevented. The position $X_2$ is determined by trial spinning operations so as to obtain an optimum roving tension such that the roving can resist a centrifugal force at termination of the winding operation even if the rotation speed of the machine is not reduced, and the occurrence of roving breakage is thereby prevented. The desired standard position $X_2$ is located below the desired standard position $X_1$. Accordingly, the roving is loosely wound during the termination of the winding operation. When the desired position $X_0$ corresponding to a certain wound diameter of the roving bobbin is thus computed at the subsequent step Q5, the correction value I corresponding to the rotation speed of the bobbin is computed by the CPU 60 from the deviation $(X_0-\overline{X})$ between the average central position $\overline{X}$ and the desired position $X_0$ and from the correction coefficient C according to the mathematical algorithm stored in the ROM 61 based on the following equation:

$$I=C(X_0-X)$$

When a correction instructing signal is received at step Q6, a correction signal is output at step Q7. This correction signal is transmitted to the motor controller 72 and the motor controller 72 rotates the control motor 70 in the normal or reverse direction based on this correction signal. The amount of rotation of the control motor 70 is converted to a pulse signal by the encoder 73. When the control motor 70 is rotated in an amount corresponding to the correction value I, a signal for stopping the control motor 70 is output. If the control motor 70 is thus rotated, the outer gear 45 of the bobbin speed change apparatus 53 is rotated in the normal or reverse direction by means of the bevel gears 71 and 71*a* and the differential gear mechanism 44, and the belt is displaced to the right or left in FIG. 2 by means of the rack 42 and belt shifter 41, whereby the rotation speed of the bobbin is decreased or increased in an amount corresponding to the correction value I and the roving tension is adjusted in the region of the front roller 8 and the bobbin 30. If correction of the rotation speed of the bobbin is performed relative to the desired position calculated according to the wound diameter of the roving bobbin, the roving tension is gradually decreased during the period from the starting point of the winding operation for formation of a package to the completion of the winding operation, and the tension of the roving suspended between the front roller of the drafting device and the flyer top is reduced with the increase of the wound diameter of the roving bobbin, with the result that the possible creation of a weak portion of roving can be remarkably reduced.

It may be further noted that, in the second example, as explained in the modification of the first example, a common control motor can be used for reducing the rotation speed of the bobbin at one layer by one layer of roving and for correcting the bobbin rotation speed according to the variation of the roving tension. In this example, as a measure corresponding to the outside diameter of the roving bobbin, an instant position of the cone belt is used, however, it is possible to directly measure the outside diameter of the roving bobbin. In this case, the method for measuring a distance such as by utilizing light, electromagnetic waves, or ultrasonic waves, is known.

In the present invention, the roving tension from the beginning of the winding operation to the completion of the operation to produce a full-size roving bobbin is decreased, however, it is also possible to operate the invention under conditions wherein the roving tension is maintained at an initial level during a period in which possible breakages of the roving, due to the influence of the centrifugal force applied to the roving, do not occur, and the roving tension is then gradually reduced in accordance with the increase of the wound diameter of the roving bobbin. That is, in the second example, the desired standard position of the roving is set at the value $X_1$ for the starting point of the winding operation and at the value $X_2$ for the time when the winding operation to create a full sized roving bobbin is completed. However, experiments have confirmed that it is possible to set several desired standard positions with pertinent time intervals in a period from the starting point to the completion of the winding operation to produce a full sized roving bobbin.

Figure 12:
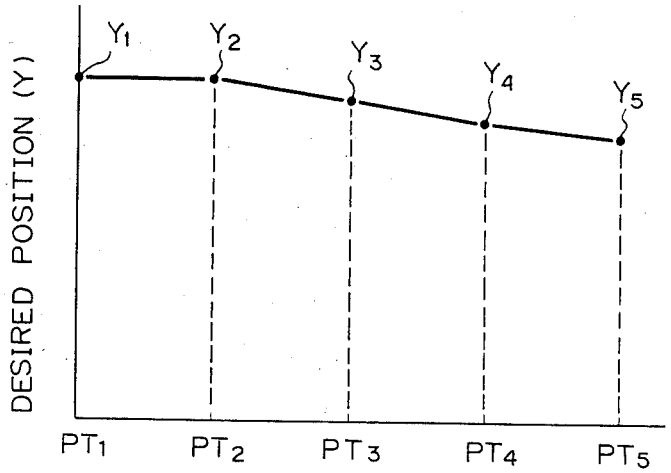
FIG. 12 is a diagram showing a principle of a modification of the second example.

For example, as shown in FIG. 12, the total displacement of the belt 36, that is, the distance of the total displacement F from the starting point to the terminal point of the cam 75, is equally divided into four sections, so that five standard positions $PT_1$ to $PT_5$ are set. And the desired standard positions of the roving $Y_1$ to $Y_5$ are set so as to correspond to the above-mentioned five standard set positions $PT_1$ to $PT_5$, respectively. In this example, the values of the desired standard positions $Y_1$ and $Y_2$ are set so as to be identical, the desired standard positions $Y_3$, $Y_4$ and $Y_5$ at the times $T_3$, $T_4$, and $T_5$ are set as being gradually reduced from $T_2$ to $T_5$. Therefore the roving tension is controlled under condition wherein the roving tension is maintained constant in a period between $Y_2$ and $T_2$, and thereafter the roving tension is gradually reduced in accordance with the increase of the wound diameter of the roving bobbin as in the above-mentioned second example.

In the above-mentioned modification of the second example, the total displacement F of the cam 75 is equally divided into four sections. However, it is possible to divide the total displacement F of the cam 75 unequally so as to set several standard set positions (desired positions).

As is apparent from the foregoing description, according to the present invention, the tension of the roving suspended between the front roller of the drafting device and the flyer top is detected as the corresponding average central position of the roving. The desired position corresponding to the diameter of the roving bobbin, which is computed based upon the desired standard position of the roving which is set by considering the increase of centrifugal force which follows the increase of the roving diameter, is compared with a detected value (average central position), so that the rotation speed of the bobbin is regulated. Therefore, the tension imposed on the roving can be reduced with the increase of the centrifugal force resulting from the increase of the wound diameter of the roving, with the result that formation of a weak portion is avoided in the roving and the possible occurrence of breakage in the roving can be prevented, especially in the large-diameter portions wound about the bobbin. Moreover, spinning can be performed without reducing the rotation speed of the roving frame, therefore, the roving production rate is not reduced. Furthermore, since the tension imposed on the roving is gradually decreased with the increase of the centrifugal force in the above-mentioned manner, it is possible to perform the winding operation such that the roving is relatively tightly wound at the initial stage of the winding operation and the roving is relatively loosely wound at the terminal stage of the winding operation. Accordingly, a package having good shape and quality can be produced and deformation or the like can be effectively prevented.

We claim:

1. An apparatus for controlling the winding speed of a roving in a roving frame during a winding operation, which comprises means for detecting the positions of said roving with respect to the vertical direction during vibration created in the portion of said roving suspended between a front roller of a drafting device of said roving frame which delivers said roving and a top of a flyer which performs said winding operation and outputting signals representing values corresponding to said detected positions, means for computing an average central position of said roving in the vertical direction during vibration from the values output by said roving position detecting means, means for computing a correction amount for the rotation speed of a bobbin associated with said flyer, said correction amount being computed from the difference between said average central position and a desired position for controlling the roving winding speed, means for generating a correction signal corresponding to the correction amount computed, and a device for changing the rotation speed of said bobbin in accordance with said correction signal.

2. An apparatus according to claim 1, further comprising means for setting a desired position of said roving, said desired position corresponding to a desired tension in said roving.

3. An apparatus according to claim 2, wherein said means for setting a desired position of said roving comprises first setting means for setting a desired standard position of said roving, which corresponds to a standard diameter of wound bobbin, and second setting means for computing a plurality of desired positions of said roving, which correspond to the respective diameters of wound bobbin during the winding operation, utilizing said desired standard position.

4. An apparatus according to claim 1, wherein said device for changing the rotation speed of said bobbin comprises bobbin speed changing means for decreasing the rotation speed of said bobbin by a predetermined quantity for every layer of roving being wound, a control motor driven in accordance with said correction signal and correcting means for correcting the rotation speed of said bobbin by means of said control motor.

5. An apparatus according to claim 4, wherein said bobbin speed changing means is driven by said control motor.

* * * * *